US010139105B2

(12) United States Patent
Hammerich et al.

(10) Patent No.: US 10,139,105 B2
(45) Date of Patent: Nov. 27, 2018

(54) METAL-CERAMIC COMPOUND GRATE BAR FOR WASTE INCINERATION

(71) Applicant: Alite GmbH, Neustadt (DE)

(72) Inventors: Jörg Hammerich, Neustadt (DE); Nicolaas van Diepen, Garbsen (DE)

(73) Assignee: Alite GmbH, Neustadt (DE)

( * ) Notice: Subject to any disclaimer, the term of this patent is extended or adjusted under 35 U.S.C. 154(b) by 0 days.

(21) Appl. No.: 15/615,487

(22) Filed: Jun. 6, 2017

(65) Prior Publication Data

US 2017/0276348 A1 Sep. 28, 2017

Related U.S. Application Data

(63) Continuation of application No. PCT/EP2016/051354, filed on Jan. 22, 2016.

(30) Foreign Application Priority Data

Jan. 26, 2015 (EP) ..... 15152528

(51) Int. Cl.

| | |
|---|---|
| ***F23H 3/02*** | (2006.01) |
| ***F23H 7/06*** | (2006.01) |
| ***F23H 7/08*** | (2006.01) |
| ***F23H 17/12*** | (2006.01) |

(52) U.S. Cl.

CPC ..... *F23H 7/08* (2013.01); *F23H 3/02* (2013.01); *F23H 17/12* (2013.01); *F23H 7/06* (2013.01); *F23H 2900/17001* (2013.01); *F23H 2900/17002* (2013.01)

(58) Field of Classification Search

CPC ..... F23H 3/02; F23H 7/06; F23H 7/08; F23H 17/12; F23H 2700/009; F23H 2900/17001; F23H 2900/17002

See application file for complete search history.

(56) References Cited

U.S. PATENT DOCUMENTS

| | | | | |
|---|---|---|---|---|
| 9,038,550 | B2 * | 5/2015 | Spliethoff ..... | F23H 7/08 110/267 |
| 2004/0159269 | A1 | 8/2004 | Williams et al. | |

FOREIGN PATENT DOCUMENTS

| | | | |
|---|---|---|---|
| BE | 383112 | A | 10/1931 |
| CN | 00205746874 | U | 11/2016 |
| DE | 19714573 | C1 | 4/1998 |
| DE | 102009016523 | A1 | 11/2010 |
| DE | 202012001080 | U1 | 3/2012 |
| EP | 1008806 | A2 | 6/2000 |
| EP | 2645034 | A1 | 2/2013 |

* cited by examiner

*Primary Examiner* — David J Laux
(74) *Attorney, Agent, or Firm* — Yakov S. Sidorin; Quarles & Brady LLP

(57) ABSTRACT

A grate bar configured to include a reinforcement structure of sheet metal and structured to be manufacture at a reduced cost while exhibiting reduced wear and enhanced resistivity to hear and corrosives. A metal-ceramic compound grate (for example—an incinerator grate) utilizing such a grate bar. An incinerator and a cooling grate including such grate bar.

15 Claims, 7 Drawing Sheets

METAL-CERAMIC COMPOUND GRATE BAR FOR WASTE INCINERATION

CROSS-REFERENCE TO RELATED APPLICATIONS

This application is a continuation of the pending International Application No. PCT/EP2016/051354 filed on Jan. 22, 2016, which designates the United States and claims priority from the European Application No. 15152528.4 filed on Jan. 26, 2015. The disclosure of each of the above-identified patent documents is incorporated herein by reference.

BACKGROUND

1. Field of the Invention

The invention relates to a grate bar. The grate bar may be used in a waste-incinerator grate or a cement clinker cooler, or a similar system.

2. Description of Relevant Art

Waste incineration (briefly, 'incineration') is commonly referred to as thermal treatment of waste to combust organic substances of waste material. To this end the waste is deposited on top of a waste-incinerator grate, heated and brought in contact with air or another oxygen source. Typically, the waste is conveyed to an outlet as a results of reciprocal movement of at least some of the grate bars or other means, while being combusted. The grate bars may be cooled by air that is injected via the grate bars into the waste material. Alternatively, water cooling is an option, but such approach has the drawback of higher installation cost and the fact that energy is removed at a low temperature, thereby reducing the efficiency of heat recovery systems such as, e.g., a turbine operating to convert heat released in the incinerator to electric energy.

Typically, the incinerator grate is a stepped grate with rows of grate bars forming steps. Each row in such grate and thus each grate bar has a rear end (facing the waste inlet) and a front end (facing in the conveying direction that is a direction in which the material is being conveyed during the operation of the system employing the grate). The rear end of each row is typically supported by cross beams, while the front end resides on the rear end of the next neighboring row of grate bars in the conveying direction. As a result of reciprocal movement of the rows, the waste is conveyed forward towards an outlet of the system, for withdrawal of residues from the incinerator.

EP 1 008 806 suggests a metallic grate bar for a waste incinerator. On top of the grate bar there is a wear layer of a ceramic composite material. The wear layer is formed by a metallic frame structure enclosing ceramic inserts. The metallic frame resembles a honeycomb structure, into which preformed ceramic inserts are positioned. Alternatively, the metallic frame may provide oval spaces for insertion of complementary ceramic inserts.

In BE 383112 A, a firing grate of iron lattice bars is disclosed. The lattice bars have recesses enabling crossing bars to fit together. But the recesses have a bent shape and thus fitting a first bar into a recess of a second bar requires heating and bending such first bar during the process of insertion, which is difficult and expensive.

DE 197 14 573 C1 teaches a waste-incinerator grate that is completely made of ceramic material. The grate is assembled from dried but not yet fired preformed grate elements. After assembly, the grate is fired to form a monolithic ceramic structure.

DE 10 2009 016 523 A1 discloses a grate bar for an incinerator with a base structure formed by steel casting. On top of the base structure there exists a temperature resistant ceramic top plate. Between the cast steel base and the ceramic top plate there is a ceramic fiber material, disposed for thermal isolation of the cast steel base from the top plate.

The authors of DE 20 2012 001 080 U1 suggest a waste incinerator grate bar with a support element that is enclosed in a fiber enforced glass body replacing ceramic materials. The temperature range for using the so-obtained waste incinerator grate bars depends on the softening temperature of the glass and is between 300° C. and 1770° C., depending on the choice of glass.

US 2004/159269 A1 relates to a gasifier combustor for drying and subsequent gasification of solid fuel. The resultant gas is subsequently moved through a duct to a combustion chamber. The gasifier combustor comprises a grate segment for a burner with an array of cavities being arranged in a honeycomb structure. The cavities are filled with a refractory material, e.g. a ceramic material.

Despite of these suggestions, grate bars for waste incineration are in practice mostly still made of heat resistant metal cast, e.g. of European Standard Steel Grade (EN 10027-2) 1.4823, by sand molds or using the lost foam casting method. The raw demolded grate bars are subsequently machined to provide the required precision of the dimensions. These grate bars are expensive and have a limited life span.

SUMMARY

The problem to be solved by the embodiments of the invention is to provide a cheap and reliable grate bar to replace conventional metallic incinerator grate bars.

Solutions to the problem are described in the independent claim. The dependent claims relate to further improvements of the invention.

According to the idea of the invention, the grate bar comprises at least a hull with a bottom and side walls, each made of sheet metal. A support structure, preferably as well of sheet metal, is inserted into and disposed inside the hull. The support structure may be connected to the hull in a force transmitting manner, e.g. by a positive locking connection, welding, gluing, or the like. It was discovered that a positive locking connection provides grate bars with an enhanced flexibility that are particularly easy to manufacture, and which can thus be manufactured at comparatively low costs.

The term hull refers to a tub-like structure, preferably of sheet metal. The hull may provide a casing for the support structure and could alternatively be referred to as 'casing'.

Compartments may be formed between said hull and said support structure and/or by each of the hull's elements and/or the support structure's elements. In other words, the spaces or gaps formed by the hull and elements of the support structure or by elements of the support structure only, are referred to as 'compartments'. During manufacture, the compartments may be filled with a ceramic slip which thus later provides a ceramic body (after curing and/or firing), i.e. a body of ceramic material. The ceramic body preferably encloses the hull and/or the support structure (at least in part or completely).

The ceramic body provides an excellent heat and wear resistance. Further, the ceramic body is robust (provides robust protection) against corrosive substances which are released during waste incineration. The ceramic material thus protects the metal hull and the reinforcement structure from the harsh conditions inside an incinerator.

Further, the sheet metal of the hull and that of the reinforcement structure enhances the tensile and flexural strength of the ceramic body assembly and thus of the grate bar as a whole. Further, the grate bar of the invention is particularly easy and cheap to manufacture as explained below in more detail.

The metallic support structure and/or the hull are/is preferably (at least in part) made of sheet metal, i.e. of individual pieces or elements of sheet metal (briefly 'pieces'). Such pieces of sheet metal can be cut and bent with remarkable precision at very low costs. For example, the piece of sheet metal may be shaped as a profile. Such profiles can be formed easily from an initially flat sheet metal piece. The profile may be, for example, tubular or it may include tubular sections, and can be manufactured by simple bending and folding (but of course as well by techniques for manufacturing seamless tubes, like e.g. the Mannesmann process or the Stiefel process). In any of the above examples, expensive metal casting simply is not necessary. In one implementation, for example, the support structure may comprise at least one, e.g. two, three or more first sheet metal pieces for example of steel (e.g. of European Standard Steel Grade (EN 10027-2) No. 1.4841, 1.4828 or the like). The hull or at least a part of the hull can be folded from sheet metal, e.g. of one of the above-named grades.

Preferably, the sheet metal of the support structure and/or the hull has recesses (at least one recess) that defined at least one opening between adjacent compartments configured to connect adjacent compartments. Thus, a fluid communication between at least two of the compartments is established prior to casting of the grate bar, i.e. in (virtual) absence of the ceramics. When casting the grate bar, the ceramic slip may thus enter the respective compartments and (after curing and/or firing the ceramic body and the sheet metal parts) engage the metal part in a positively-locking manner, providing high strength to the grate bar overall.

The grate bar may have at least a first (top surface, during the normal operation) surface configured to support waste during its incineration, or more generally configured to support any matter to be processed on the grate. Such first top surface is preferably formed by the ceramic material. The first top surface is preferably at least essentially flush (leveled) to enhance material (e.g. waste) transport. In addition, if the metal support structure (and, preferably, also the hull) is completely covered by ceramic material, the so covered sheet metal is well protected against corrosion and abrasion. Threaded insert elements or units (configured to provide means for attaching the grate bar to another grate bar), or bolt heads (for fixing the grate bar or parts thereof, such as, for example, a replaceable front plate) if present in the structure, should not be covered by the ceramic material.

The grate bar may also have at least a second (top, during normal operation of the system) surface in a rear end section of the grate bar. This second top surface is configured to support the lower side of a front end section of a similar neighboring grate bar when forming the grate. The component having the second top surface includes a metal plate, which is positioned on top of the side walls of the hull. In other words, the "up" facing surface of the grate bar may comprise at least first and second sections. Here, the term "first section" refers to first top surface, and the term "second section" refers to a second top surface. The metal plate may be covered with a ceramic layer as well (i.e. a layer of ceramic material), in which case the second top surface is a surface of the ceramic material. The metal plate provides additional reinforcement to the grate bar to absorb the load being exerted by the front end section of an antecedent, neighboring grate bar. Furthermore, the metal plate provides a sliding surface for sliding support of a front section of another, neighboring grate bar. Such grate bar is thus particularly suited for integration in a stepped incinerator grate and/or a cement clinker cooler grate.

Preferably, the metal plate (and/or the side walls of the hull) have at least one protrusion that is engaged into a complementary recess of the side wall (and/or the metal plate), respectively. As a result of such engagement, a positively locking connection between the metal plate and the side walls is obtained, which leads to the simplification of the manufacturing process because welding or similar processes can be simply omitted. This positive locking eases the assembly of the grate bar and enables to transfer shearing forces from the metal plate to the side walls of the hull, and vice versa. These shearing forces occur when a chosen grate bar is reciprocated relative to an antecedent grate bar that resides with its front end section on the second top surface.

The first top surface of ceramic material is preferably at least substantially (with a possible angular deviation within ±15°, preferably within +/−10°) parallel to the second top surface, and, when the grate bar is positioned such that the first top surface is horizontal, is located at a level below the second top surface. When installed, surfaces of the grate bars may be generally inclined.

Preferably, the support structure includes at least two pieces of sheet metal that has first and second (left and right, in a particular orientation) narrow sides (also referred to as edge surfaces). For example, a piece of the support structure may have an essentially rectangular outline, (which is easy to cut from a sheet metal with a small number of cutting operations). When these pieces are inserted in the hull to reinforce it and to form the support structure, the first edge surface of the piece is facing one side wall while the second and opposite edge surface of the piece is facing another side wall. (In a particular orientation, for example, the right narrow side of a given piece of the support structure may face towards the right side wall of the two side walls of the hull, while the left narrow side of the same piece may face towards a left side wall of the two side walls). Accordingly, the "bottom" narrow side or edge surface of the piece may face towards the bottom of the hull. Only to avoid the ambiguity, prior to folding, bending and similar transformation of a piece of sheet metal, such piece typically has two essentially congruent sides, namely a front side and a rear side (first and second surfaces that are opposite one another). These front and rear sides or surfaces are connected by a third, thin side, referred to as a narrow side (or edge surface). The narrow side is typically defined by the surface that is formed and becomes visible when a smaller piece of sheet metal is cut from a bigger sheet metal. One may refer to the upper, lower, left or right narrow sides, which are parts of the framing thin side, and which are visible when looking from the top, from below, from the left or from the right, respectively.

The support structure provides a particularly strong reinforcement to the grate bar if the two pieces engage with each other. For example, each piece of the support structure may have a slit, into which the respective other of these two pieces is inserted to form a pair of sheet metal pieces affixed to one another. The two engaged pieces may for example take the form of a cross, e.g. resemble a St. Andrew's cross.

Preferably, at least one of these pieces engages with the hull to further enhance stability of the grate bar. For example, the piece of the supporting structure may have at least one protrusion that is engaged, after assembly, a complementary recess of a side wall (and/or vice versa). It is preferred, however, that the piece of the support structure and/or the hull has two or more protrusions each engaging into a corresponding complementary recess (of the hull and/or the piece), respectively, for example one into each side wall. An additional protrusion present at the piece of the support structure may be dimensioned to fittingly engage into the hull's bottom and/or vice versa).

Preferably, the sheet metal piece extends slantingly or obliquely between the two sidewalls of the hull and engages with each or at least one of these hull's side walls. The term "slantingly" is intended to express a situation when an axis identifying a longitudinal direction of the sheet metal piece forms an angle with an axis that identifies a longitudinal direction of the respective side wall, and when such angle is not 90° (and is not 0°). This term, for example, can be used in one implementation to denote angles between 30° and 60° (or, in a related implementation, angles between 10° and 80°). By arranging the pieces slantingly or obliquely, the bending and torsional stiffness of the grate bar is enhanced.

In particular, a slantingly extending piece may comprise at least one protrusion that is formed when a part of the piece is bent towards the closest of the side walls. The bent part then forms an angle with the longitudinal direction of the side wall (such angle being closer to 90° than the angle formed by a non-bent part of the piece and the same longitudinal direction). Accordingly, the piece (that is dimensioned to fit into the hull) can be manufactured very cheaply from an essentially rectangular sheet metal that is by simply cutting a side of the sheet metal and bending a portion of the sheet metal on a side of such cut in the direction of a side wall. Profiles can be cut and bent accordingly. Further, through-holes can be formed on the piece of sheet metal (preferably prior to inserting them into the hull) to connect the compartments between different sheet metal pieces and/or the hull's walls after insertion of the sheet metal pieces in said hull, as explained above.

Preferably, at least one threaded insert element is connected to and supported by at least one of the side walls of the hull and/or the support structure. The threaded insert element is preferably not enclosed with or contain ceramic material, and is configured to attach, to the grate bar, parts that need to be adjusted and/or replaced from time to time. In some embodiments, for example, a front plate may be connected to the hull and/or the support structure by at least one bolt that engages with at least one threaded insert element, or with a bolt that is supported by the support structure, e.g. at least one of said pieces or a cross part extending like the pieces in the hull but orthogonally to the longitudinal direction. Beyond, adjacent grate bars can be connected with each other by bolts engaging in at least one threaded insert element.

Preferably, the hull has a metal front plate extending below the hull's bottom. The lower part of the front plate, i.e. the part that extends below and beyond the hull's bottom, is configured to support the grate bar by residing on a rear section of another, neighboring grate bar.

It is preferred to have the front plate shaped in a U-like fashion, that is as a profile with a U-like side view. This provides a particular stable grate bar having a sliding surface simplifying to reciprocate the grate bar, while the front plate resides on a subsequent grate bar (seen in the direction of transport), in addition it is simple to manufacture and thus does help to keep costs low. When the front plate is shaped in the U-like fashion, as seen in profile it may comprise a first longer leg or portion attached to the front narrow sides (or edge surfaces) of the side walls and/or the bottom portion of the hull. Further the U-like profile has a shorter portion (interchangeably referred to as a leg) supporting the hull's bottom. A middle leg or portion that is between the first longer leg or portion and the shorter leg or portion provide a sliding surface for sliding over the rear section of another grate bar (when the two grate bars are assembled together).

The grate bar may comprise at least one gas channel with a gas inlet and a gas outlet on the top and/or frontal surface of the grate bar. When the gas is cooling gas, such channel is configured to cool the grate bar and to provide gas to the matter residing on top of the grate bar. Alternatively, the gas may include air or another source of oxygen to enhance incineration of waste on top and/or in front of the grate bar.

The grate bar structured according to the idea of the invention may be manufactured at significantly lower costs than the prior art grate bars requiring cast metal. To this end, the hull and the support structure are positioned in a casting mold. The casting mold has the negative intended form of the grate bar and provides space for a slip (that later forms the ceramic body of the grate bar). A slip is typically an aqueous suspension of the ceramic's raw materials, such as a composition comprising at least one of Silicon Carbide (SiC), Aluminum Oxide (Al2O3), Silicon Oxide (SiO2), and similar materials.

Next, the ceramic slip is inserted in the casting mold. The ceramic slip encloses the hull and the support structure at least in part. The casting mold and/or the slip may be subjected to vibrations to release air bubbles. The slip may include elongated metal pieces or fibers (subsequently referred to as 'needles', only to enable a linguistic distinction to the sheet metal pieces of the support structure). These needles form a micro structure enclosed in the ceramic body. Preferably, the needles are added to the ceramic slip prior to filling in the ceramic slip into the casting mold, to obtain a homogenous distribution of the needles in the later-formed ceramic body.

The slip may be dried. The dried slip of the intermediate product is referred to as green body. By curing and/or firing of the intermediate product the green body is converted into ceramics, i.e. into a ceramic material. Depending on the heat resistance of the casting mold, the semi-finished grate bar may have to be removed from the mold prior to conversion of the dried slip into ceramics. For example, the slip may be cured at low temperatures (e.g., at a temperature ranging from ambient temperature to 100° C.) which are within the specification of typical (low cost casting mold materials, such as silicone. After curing, the semi-finished grate bar (i.e. the intermediate product) can be removed from the mold and subsequently subjected to heat as required for sintering the ceramics. This is a process usually referred to as 'firing' the ceramics. Optionally, tempering may be appropriate. Thus, the casting mold may be manufactured a low cost, as it does not need to withstand the high temperatures as required for sintering and/or tempering the ceramic body, e.g. simple molds of silicone (polymerized siloxanes) may be used.

The ceramic material may comprise additional aggregates to further enhance its tensile strength, for example the elongate metallic pieces, as explained above. These elongate metallic pieces can be added to the ceramic slip prior to curing.

An incinerator grate utilizing the above described grate bars is extremely long lasting, operationally speaking, and at the same time much cheaper than prior art incinerator grates because expensive metal casting process can be omitted completely during the manufacture of the grate bars. The same holds true for a cement clinker cooler grate comprising the above described grate bars.

Gas channels for providing a gas from below the grate bar to the subject matter on top of the grate bar (e.g. waste) may be formed or created by inserting a positive form ('positive', for short) of the intended gas channel in the mold prior to drying the slip, preferably prior to filling the slip into the mold. The 'positive form of the gas channel' is a placeholder for a later gas channel. After drying the slip, the positive can be removed from the green body as explained below in more detail, and the gas channel is thereby opened. This method enables the user to design gas channels in almost any way, and thus to adapt their form to the needs of the process(es) taking place on top of the grate bar. At least one gas channel may be designed to obtain a homogeneous gas injection in the matter to be processed. Alternatively, at least one nozzle providing a concentrated gas beam may be formed, which may be used to clean a part of a surface of the grate bar.

Preferably, the positive form of the gas channels is made of a non-heat resisting material. The non-heat resisting material can be selected to withstand the temperatures at which the slips is dried prior to demolding, but should become fluid or simply disintegrate when firing the green body, later forming the ceramic body. Disintegration means any process that removes the form from the green body, e.g. by pyrolysis, burning, evaporation, dissolving, etc.

The positive form may be e.g. of a preferably thermoplastic carbon-based polymer, like polyethylene or the like. This enables simple shaping of the positive form. Further, these polymers remain solid at typical temperatures chosen for drying the slip. When heating the green body, the polymers may simply become fluids and get poured out of the green body. If parts of the polymer cannot be removed by pouring out, such part get pyrolized or simply burnt off when converting the green body into ceramics during the firing step of the process.

Alternatively, the positive form (i.e. the place holder of the gas channel) may be removed by dissolving of the corresponding material, even machining may be used.

In a cement clinker cooler (briefly clinker cooler) different but similar harsh conditions (such as those in a waste incinerator) prevail: The clinker is unloaded with a temperature of about 1350° C to about 1450° C. from a kiln onto the clinker cooler. The clinker is very abrasive when transported from the kiln to the clinker outlet. The grate bar of the invention, however is as well perfectly suited for use as grate bar of a cement clinker cooler grate, because the ceramic body of such grate bar is perfectly suited to withstand the abrasion and the heat; moreover, due to the armoring of the ceramics by the support structure and the hull, the loads of the clinker can be supported. Thus, the grate bars of the invention can be used as well as grate bars in clinker coolers, to replace conventional grate bars (such as those disclosed in the patent specifications of U.S. Pat. No. 5,299,555 and EP 2559961, which are incorporated herein by reference as if fully disclosed). In this case, the matter to be processed on the grate is not waste during its incineration, but clinker when cooled down. Thus, instead of injecting an oxygen source, e.g. air, via channels into the waste to provide oxygen to the combustion process, a cooling gas is injected into the clinker bed residing on top of the grate. The cooling gas can contain air as well, but oxygen is not required for cooling down the clinker. The oxygen may be required when the heated cooling gas is used as secondary and/or tertiary air for the clinker kiln and/or a calciner, respectively, but that concerns another aspect of clinker manufacturing. In other clinker lines, oxygen should be avoided as coolant, to obtain essentially white cement clinker.

BRIEF DESCRIPTION OF THE DRAWINGS

In the following, the invention will be described by way of example, without limitation of the general inventive concept, on examples of embodiment and with reference to the drawings.

Figure 1:
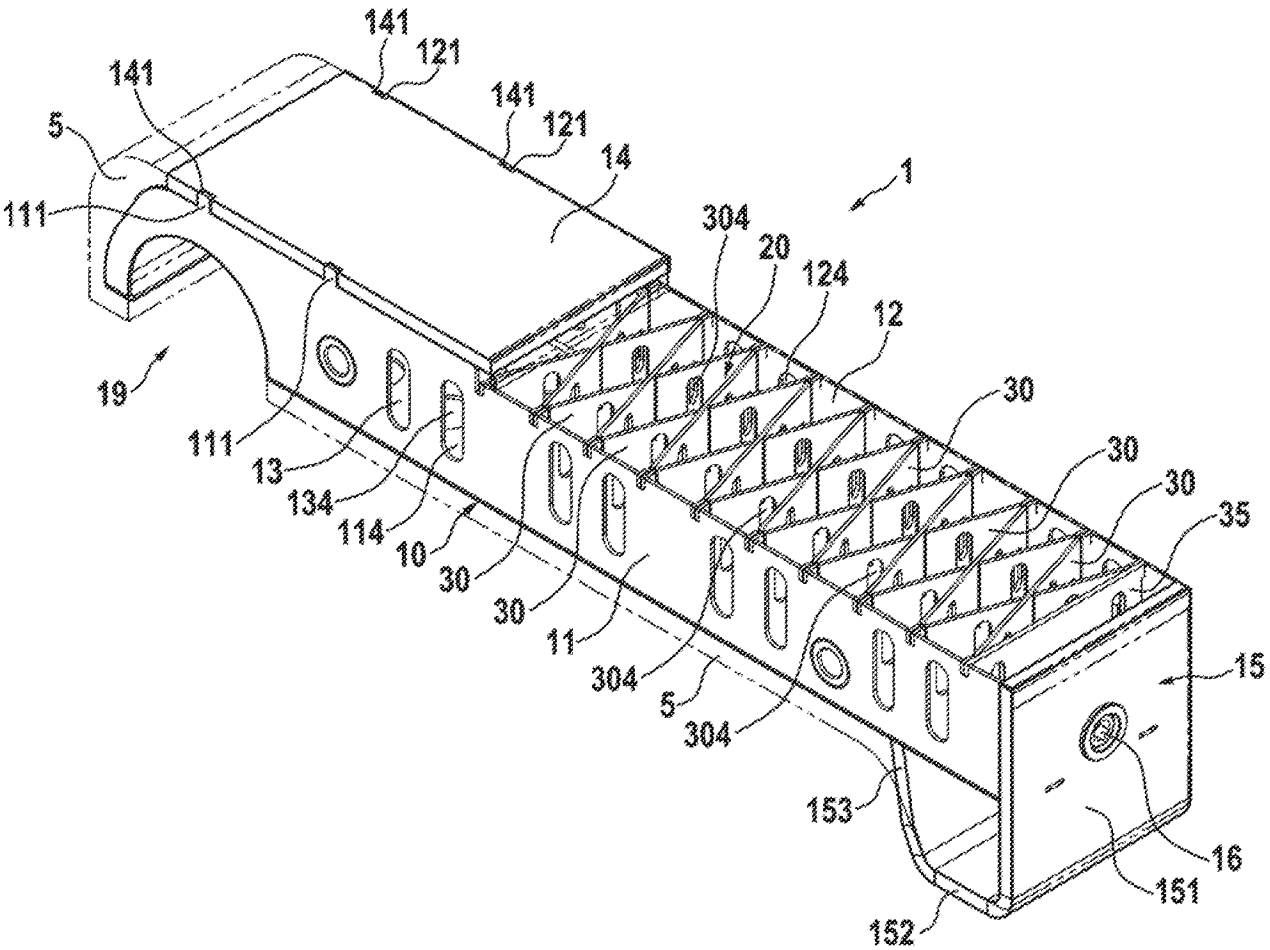
FIG. 1 shows an isometric view of a grate bar.

Various modifications and alternative forms of the embodiments are within the scope of the present disclosure, specific embodiments of the invention shown in the drawings provide but examples. These will be now described in detail. It should be understood, however, that the drawings and detailed description are not intended to limit the scope of the invention to the particular disclosed form(s), but to the contrary, the intention is to cover all modifications, equivalents and alternatives falling within the spirit and scope of the present invention as defined by the appended claims.

DETAILED DESCRIPTION

The grate bar 1 in FIG. 1 has a metal structure of a hull 10 and support structure 20. The hull has a bottom 13 and side walls 11, 12, each preferably of sheet metal. The front of the hull 10 is formed by a front wall 15. The side walls 11, 12 may be congruent, as shown. The bottom 13 and the side walls 11, 12 are formed from a single piece of sheet metal by cutting the sheet metal and folding the sheet metal. Alternatively, the side walls 11, 12 and the bottom 13 may be cut separately and be connected by any appropriate method, e.g. welding. The hull 10 and the support structure 20 are enclosed in a ceramic body 5 made of ceramic material 5, which is indicated only by dashed lines (otherwise the support structure and parts of the hull would be hidden). The grate bar 1 has a recess 19 at the rear and of its down facing side to engage with a cross beam (not shown) of an incinerator grate.

Figure 2:
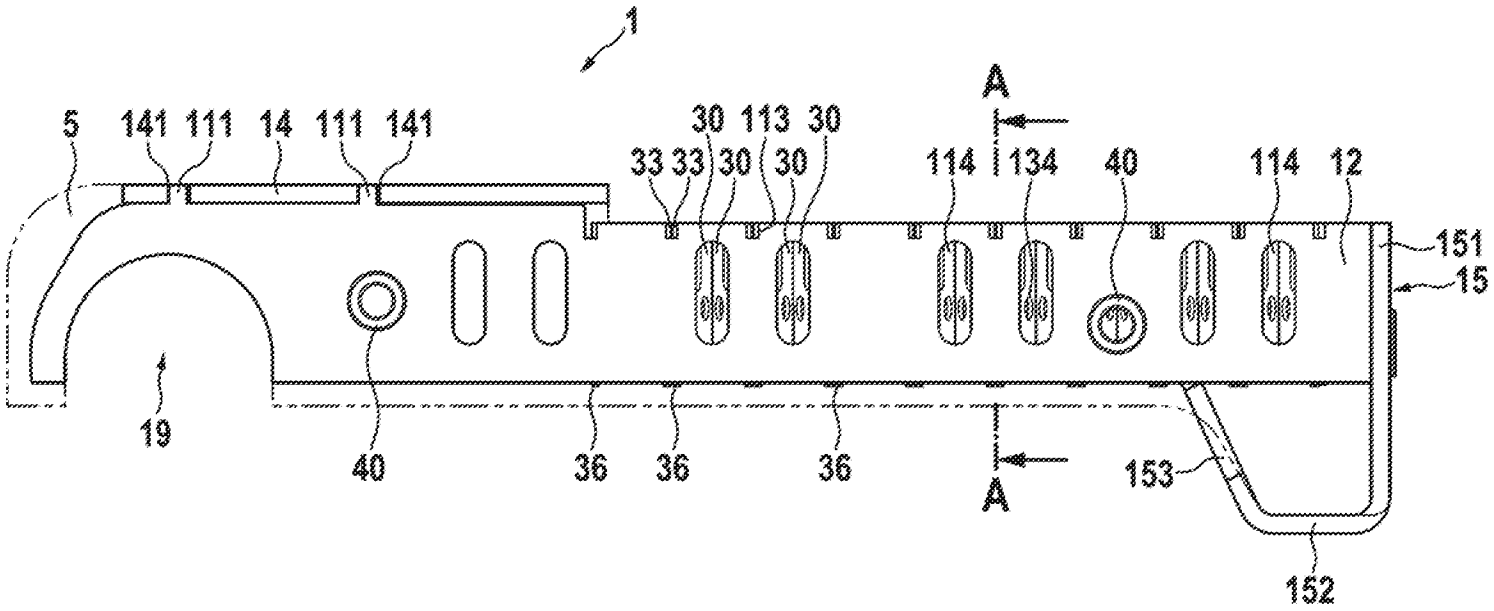
FIG. 2 shows a side view of the grate bar of FIG. 1.
Figure 3:
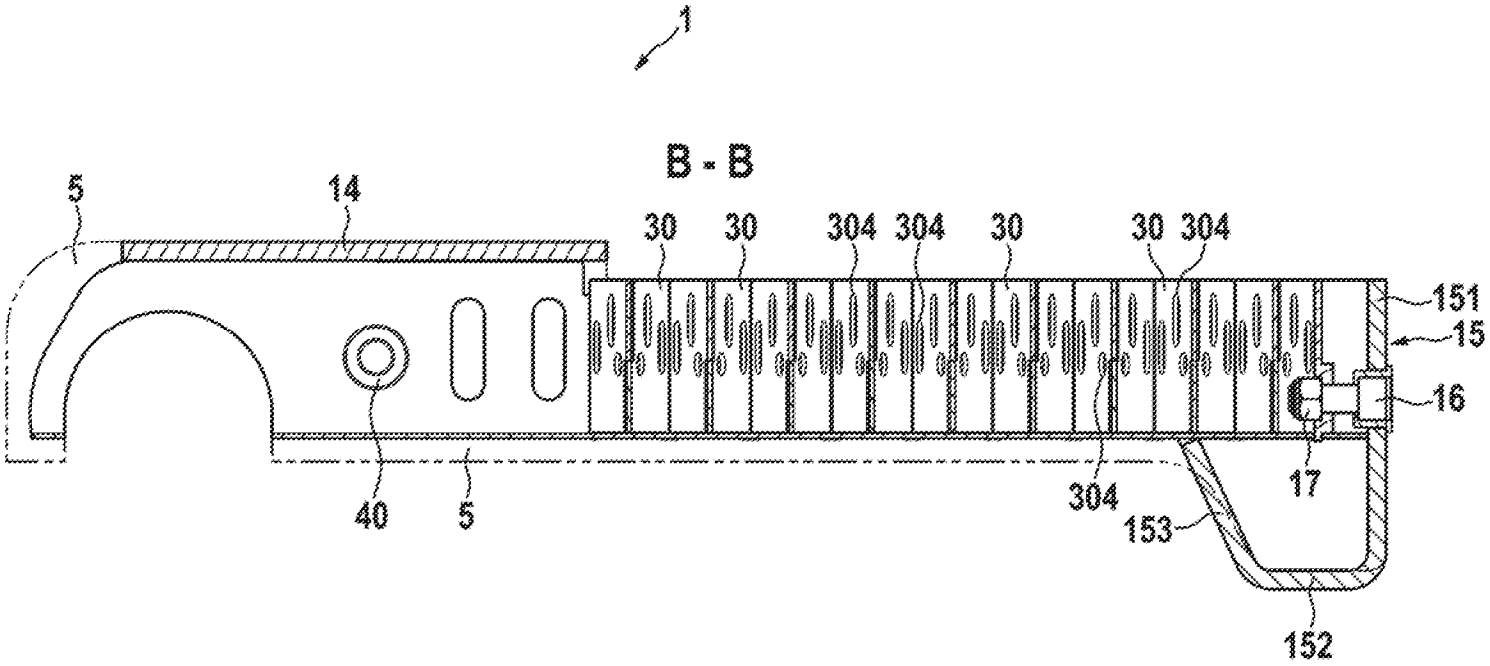
FIG. 3 shows a longitudinal section (along plane B-B indicated in FIG. 4) of the grate bar of FIG. 1.

The hull 10 has a front section and a rear section. The rear section may be covered by a metal plate 14 being supported by the side walls 11, 12. As shown in FIGS. 1, 2 and 3 the side walls 11, 12 and the metal plate 14 may engage with each other, to thereby ease assembly of the metal structure and to enable transfer of shearing forces between the side walls 11, 12 and the metal plate. In the depicted example the side walls 11, 12 have protrusions 111, 121 each engaging into a recess 141 of the metal plate 14 and thus form fittingly connecting the side walls 11, 12 and the metal plate 14. Of course the side walls 11, 12 could as well have recesses into which the metal plate 14 is inserted or into which protrusions of the metal plate 14 engage.

The front plate 15 of the hull resembles or can be considered to be a profile with a first leg or portion 151 being attached to the side walls 11, 12 front narrow sides (edge surfaces) and/or the bottom's 13 front narrow side (or edge surface). The first leg or portion 151 extends below the bottom, there the front plate 15 is bent to provide an intermediate leg or portion 152 (second leg or portion), with a middle section being at least approximately parallel to the bottom. From the middle section a third leg or portion 153 is bent upwards to support the bottom 13 at its lower facing side.

Inside the hull 10 is a support structure 20 of sheet metal pieces 30. Each sheet metal piece 30 extends between the side walls 11, 12, i.e. the right and left narrow sides of the pieces 30 face towards the respective side wall 11, 12. However, the pieces 30 do not necessarily extend orthogonally between the side walls but may preferably extend slantingly (as depicted). Only to avoid any confusion slanting is to be understood as 'in an oblique angle' as explained in more detail above. Every piece 30 forms an angle opposed to its adjacent pieces. Thus, two adjacent pieces 30 form opposed angles with the side walls 11, 12.

Figure 4:
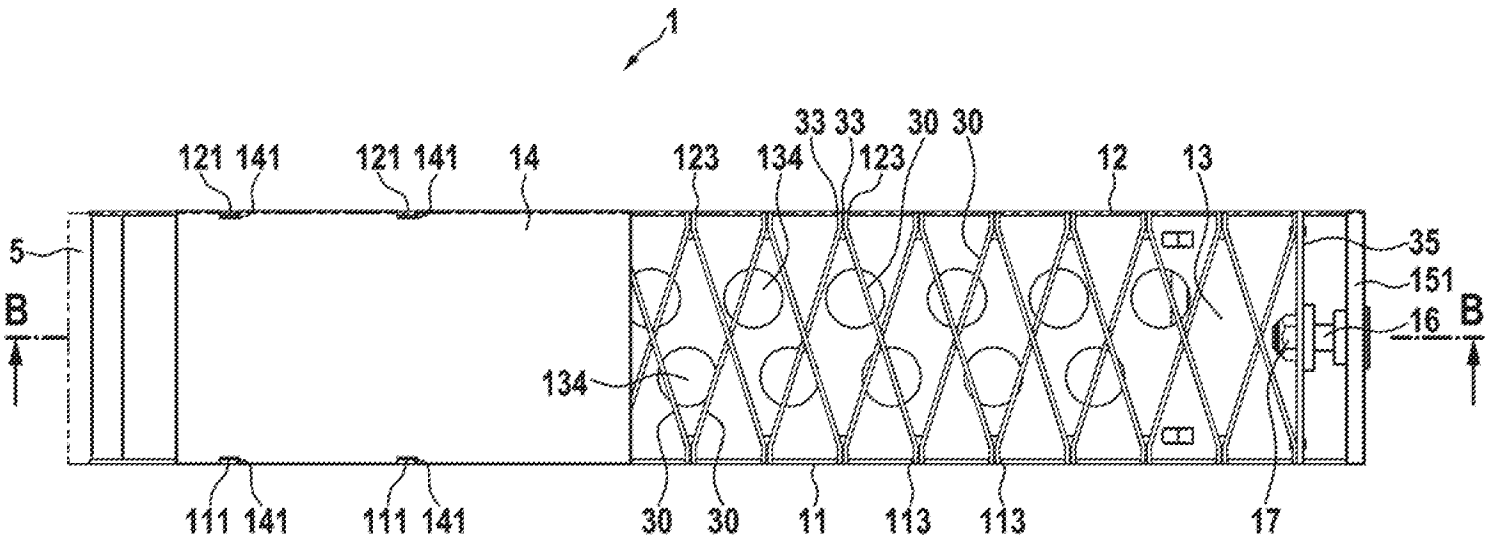
FIG. 4 shows a top view of the grate bar of FIG. 1.
Figure 5:
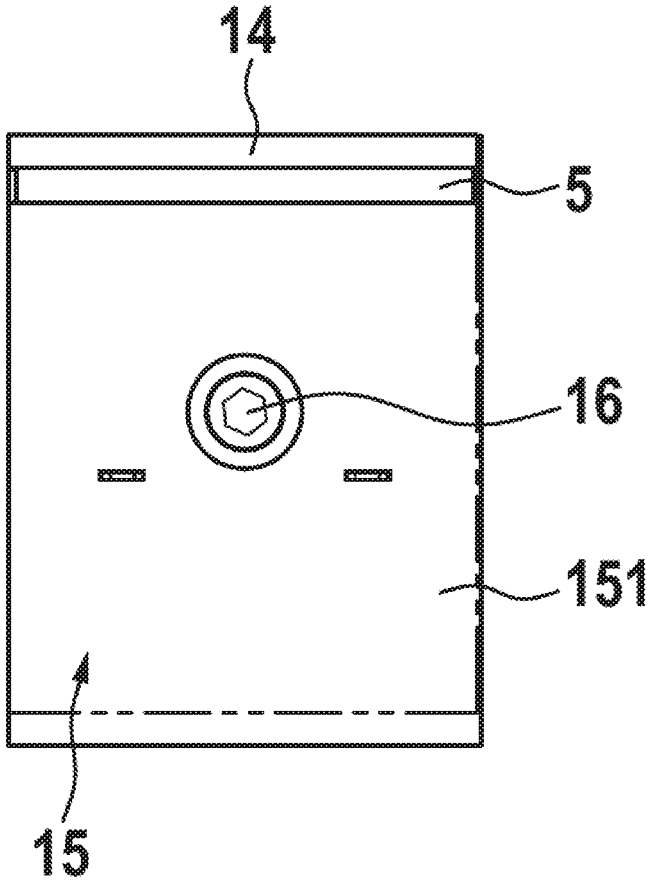
FIG. 5 shows a front view of the grate bar of FIG. 1.
Figure 6:
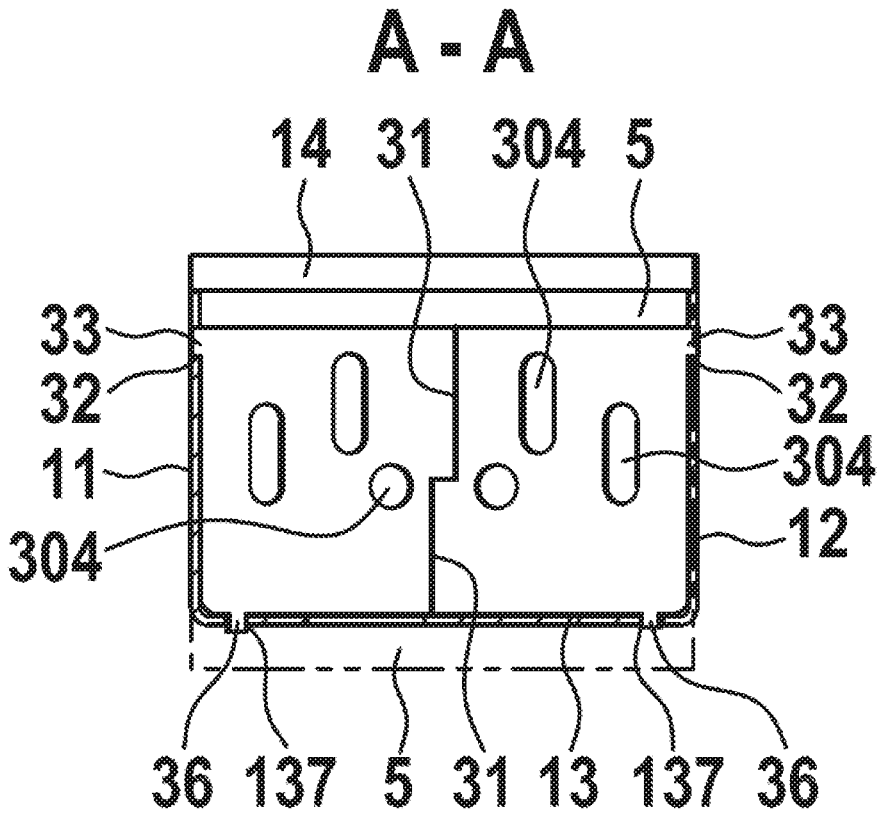
FIG. 6 shows a cross section (along plane A-A indicated in FIG. 2) of the grate bar of FIG. 1.

The pieces 30 are assembled to form a pair of engaging pieces 30 as can be best seen in FIG. 1, FIG. 4 and FIG. 6. To this end, each piece 30 has a slit 31 into which the other piece 30 of the pair is inserted. The other piece 30 has a complementary slit 31 to accommodate the remaining part of the first of said pieces. In the top view (FIG. 4) each pair of sheet metal pieces 30 resembles a Saint Andrew's cross.

As can be seen best in FIG. 6, the pieces 30 of each sheet or at least some of them each may have two cuts 32 from the left and right narrow sides towards their respective other narrow side. Thus, at each side of the piece 30 may be an upper sheet metal part 33, i.e. the material of the piece 30 above the cut. These parts can be bent towards their respective next side wall 11, 12 and thereby form protrusions 33 which can engage into recesses 113, 123 of the side wall 11, 12. The pieces 30 of sheet metal can thus simply be hung into the hull 10 when manufacturing the grate bar. Additionally the pieces 30 may have protrusions 36 (FIG. 2 and FIG. 6) extending from their lower narrow side into recesses 137 (FIG. 6) of the bottom 13.

The hull 10 and the pieces 30 forming the support structure 20 may have through holes 114, 124, 134, 304 to enable a ceramic slip to fill each compartment of the metal structure and to provide a reliable engagement between the sheet metal and the ceramic body by positively-locking the (later) ceramic body and the sheet metal structure (FIG. 1 to FIG. 4 and FIG. 6).

The hull 10 and the support structure 20 may be assembled and subsequently provided into a negative mold of the grate bar 1. The mold is subsequently filled with a ceramic slurry, usually referred to as ceramic slip. After initial hardening of the ceramic slurry, the cured grate bar can be removed from the mold, further dried (if necessary) and fired. Thus, the form does not need to withstand high temperatures and can be made of correspondingly cheap material and/or may be reusable.

The front plate 15 may be replaceable as shown in FIG. 1 to FIG. 5: The front plate 15 is bolted using bolt 16 to a cross piece 35 supporting a nut 17 into which the bolt 16 engages. In the depicted example, the cross piece 35 is a sheet metal plate, being inserted in the hull. The cross piece engages with the hull like the sheet metal pieces 30. Alternatively, the cross piece could be a cross beam connecting the side walls 11, 12 or a profile.

In case the front plate is worn off, the bolt can be released and the front plate 15 can be replaced by a new or at least less worn front plate 15 which is bolted to the cross part 35. The cross part 35 extends like the pieces 30 in the hull 10, but different to said pieces 30 it extends preferably orthogonally to the longitudinal direction of the grate bar 1.

As can be seen in FIG. 2, threaded insert elements 40 are attached to recesses in the hull, in particular in the side walls 11, 12 and enable to connect multiple grate bars 1 to form a row of grate bars.

Figure 7:
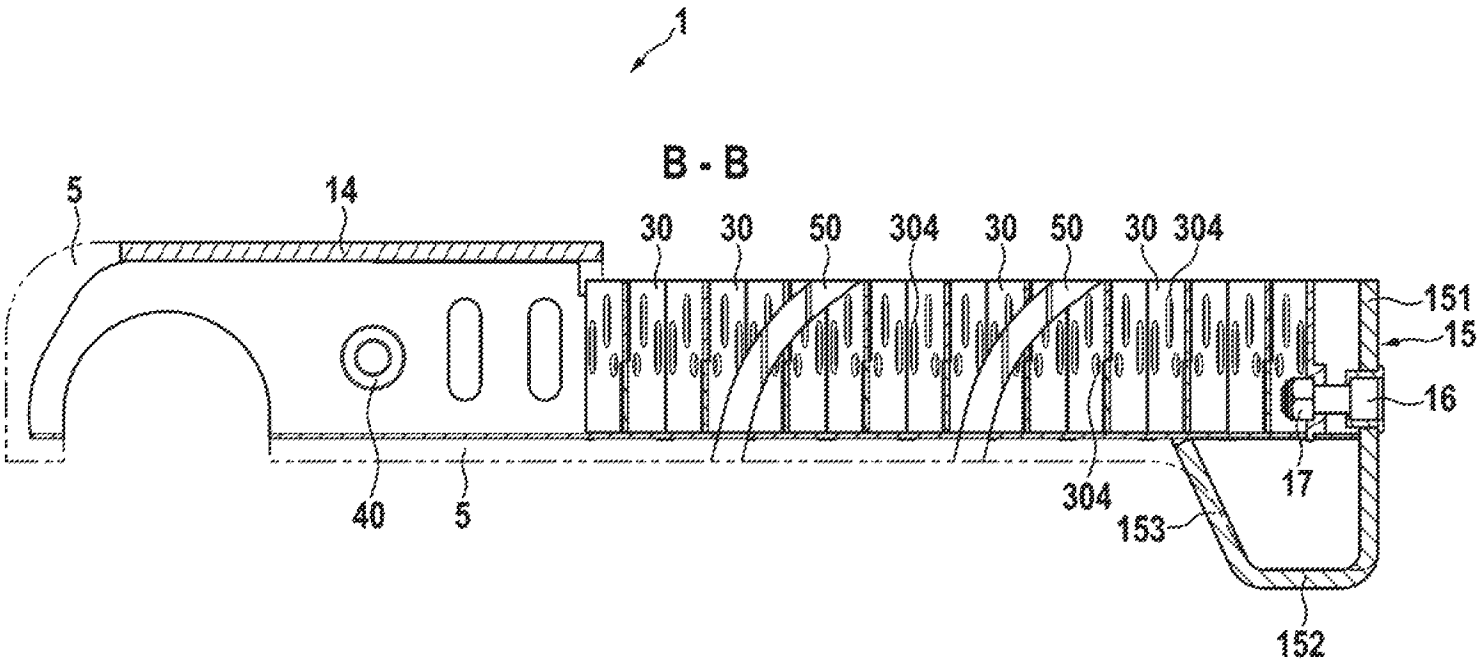
FIG. 7 shows a longitudinal section like FIG. 3, but of a grate bar with gas channels.

The grate bar as shown in FIG. 7 is almost identical to the grate bar as depicted in FIG. 1 to FIG. 6, accordingly the description referring to FIG. 1 to FIG. 6 can be read on FIG. 7 as well, But different from the grate bar of FIG. 1 to FIG. 6, the grate bar as shown in FIG. 7 has gas channels 50 for providing a gas, e.g. air from below of the grate bar to the top of the grate bar. The gas channels are shown only schematically. Gas flowing through said gas channels 50 may be used for processing the matter residing on the grate bar, e.g. as coolant for cooling cement clinker or as oxygen source for waste incineration. The number of gas channels is not limited to the depicted number, any number may be chosen ("at least one"). A gas channel can be formed in the grate bar by first providing corresponding recesses in the support structure and by insertion of a positive form as placeholder of the later gas channel(s) 50 in the hull 10 and the support structure 20. Subsequently, the hull 10 with the support structure 20 and the positive form is inserted into a mold and ceramic slip may be inserted into the mold. After drying of the slip, the positive form is removed from the green body. In the simplest form, the positive form, i.e. the placeholder liquefies when firing the green body to convert it into ceramics and pours out of the grate bar 1. Other techniques for removal of the placeholder(s) may be applied as well.

It will be appreciated to those skilled in the art having the benefit of this disclosure that this invention is believed to provide a grate bar for a waste incinerator grate and as well for a clinker cooler grate. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

1 grate bar
5 ceramic body/ceramic material
10 hull
11 side wall
111 protrusion
113 recess
114 through hole
12 side wall
121 protrusion
123 recess
124 through hole
13 bottom
134 through hole
137 recess
14 metal plate

141 recess
15 front plate
151 first leg or portion
152 second leg or portion
153 third leg or portion
16 bolt
17 nut
19 recess
20 support structure
30 piece of sheet metal
31 slit
32 cut
33 protrusion of left or right narrow side/upper part
35 cross piece, e.g. a plate of sheet metal, a cross beam, a profile etc.
36 protrusion of lower narrow side
304 through hole
40 threaded insert element
50 gas channel

The invention claimed is:

1. A grate bar comprising:

a hull with a bottom and first and second side walls, said bottom and first and second side walls made of first sheet metal, at least one of the first and second side walls containing a recess;

a support structure inserted into said hull to form compartments between said hull and said support structure, the support structure made of second sheet metal;

the compartments containing a ceramic material, wherein the support structure contains at least two pieces of the second sheet metal, each of the at least two pieces of the second sheet metal having first and second edge surfaces; wherein a first edge surface of the at least two pieces faces the first side wall while the second edge surface of the at least two pieces of the second sheet metal faces the second side wall; and wherein at least one of said at least two pieces of the second sheet metal engages in the recess.

2. The grate bar of claim 1, wherein the second sheet metal has recesses configured to establish fluid communication between at least two of said compartments, wherein at least one of the recesses is at least partially filled with said ceramic material and wherein at least two of said compartments are filled with said ceramic material at least in part.

3. The grate bar of claim 1, further comprising a first top surface formed by said ceramic material.

4. The grate bar of claim 3, further comprising at least a second top surface in a rear end section of the grate bar, said second surface comprising a surface of a metal plate positioned on edge surfaces of the first and second side walls of said hull.

5. The grate bar of claim 4, wherein at least one of (i) the metal plate and (ii) the first and second side walls has a protrusion, and at least one of (a) the first and second side walls and (b) the metal plate has a recess complementary to said protrusion, said protrusion engaging into said complementary recess.

6. The grate bar of claim 4, wherein, when the second top surface is positioned horizontally, the first top surface of ceramic material is substantially parallel the second top surface and located at a level below said second top surface.

7. The grate bar of claim 1, wherein each of the at least two pieces of the second sheet metal has a slit dimensioned to accommodate another of said at least two pieces of the second sheet metal, and wherein a first of the at least two pieces of the second sheet metal is inserted into the slit of a second of said at least two pieces of the second sheet metal to affix the first and second of the at least two pieces of the second sheet metal to one another.

8. The grate bar of claim 1, wherein, when the support structure is inserted into the hull, at least one piece, from the at least two pieces of the second sheet metal, extends slantingly with respect to a side wall from the first and second side walls, said at least one piece having a cut through an edge surface thereof and being partially bent along the cut to form a bent portion and a protrusion with respect to the bent portion;

wherein the protrusion is engaged in to a recess of the closest of the first and second side walls.

9. The grate bar of claim 1, further comprising at least one threaded insert element is connected to and supported by at least one of said first and second side walls.

10. The grate bar of claim 1, further comprising a metal front plate extending below a bottom of the hull.

11. The grate bar of claim 10, wherein the metal front plate is bent in a U-shaped fashion to form a first leg and a second leg, the first leg being longer than the second leg, with the first leg being attached to front edge surfaces of the first and second side walls and the second leg supporting a bottom of the hull.

12. The grate bar of claim 1, further comprising at least one combustion air channel, with an inlet and an outlet, configured to deliver combustion air to at least one of a top portion of the grate bar and to an area in front of the grate bar.

13. The grate bar of claim 1, wherein the support structure comprises at least one piece of sheet metal forming a tubular section.

14. An incinerator comprising a grate bar that includes a hull with a bottom and first and second side walls, said bottom and first and second side walls made of first sheet metal, at least one of the first and second side walls containing a recess;

a support structure inserted into said hull to form compartments between said hull and said support structure, the support structure made of second sheet metal;

the compartments containing a ceramic material, wherein the support structure contains at least two pieces of the second sheet metal, each of the at least two pieces of the second sheet metal having first and second edge surfaces;

wherein a first edge surface of the at least two pieces of the second sheet metal faces the first side wall while the second edge surface of the at least two pieces of the second sheet metal faces the second side wall; and wherein at least one of said at least two pieces of the second sheet metal engages in the recess.

15. A cooling grate comprising a grate bar that includes a hull with a bottom and first and second side walls, said bottom and first and second side walls made of first sheet metal, at least one of the first and second side walls containing a recess;

a support structure inserted into said hull to form compartments between said hull and said support structure, the support structure made of second sheet metal;

the compartments containing a ceramic material, wherein the support structure contains at least two pieces of the second sheet metal, each of the at least two pieces of the second sheet metal having first and second edge surfaces;

wherein a first edge surface of the at least two pieces of the second sheet metal faces the first side wall while the second edge surface of the at least two pieces of the second sheet metal faces the second side wall; and wherein at least one of said at least two pieces of the second sheet metal engages in the recess.

* * * * *